US005250799A

United States Patent [19]

Werner

[11] Patent Number: 5,250,799

[45] Date of Patent: Oct. 5, 1993

[54] METHOD FOR ADAPTING THE LIGHT INTENSITY OF THE SUMMATION LIGHT TO THE EXTERNAL LIGHT

[75] Inventor: Walter Werner, Dornbirn, Austria

[73] Assignee: Zumtobel Aktiengesellschaft, Austria

[21] Appl. No.: 828,917

[22] PCT Filed: Jul. 27, 1990

[86] PCT No.: PCT/EP90/01230

§ 371 Date: Jan. 28, 1992

§ 102(e) Date: Jan. 28, 1992

[87] PCT Pub. No.: WO91/02441

PCT Pub. Date: Feb. 21, 1991

[30] Foreign Application Priority Data

Jul. 27, 1990 [DE] Fed. Rep. of Germany ..... 3925151

[51] Int. Cl.[5] ..... H01J 40/14

[52] U.S. Cl. ..... 250/214 AL; 315/154; 315/158

[58] Field of Search ..... 250/214 AL, 205; 315/152, 153, 154, 151, 157, 158, 159

[56] References Cited

U.S. PATENT DOCUMENTS

| | | | |
|---|---|---|---|
| 3,180,978 | 4/1965 | Mas | 315/154 |
| 4,225,808 | 9/1980 | Saraceni | 315/154 |
| 4,233,545 | 11/1980 | Webster et al. . | |
| 4,273,999 | 6/1981 | Pierpoint | 250/214 AL |
| 4,647,763 | 3/1987 | Blake | 250/214 AL |
| 4,701,669 | 10/1987 | Head et al. . | |
| 5,019,747 | 5/1991 | Morita et al. | 250/214 AL |

FOREIGN PATENT DOCUMENTS 2174679 10/1973 France .

OTHER PUBLICATIONS

Rubinstein et al., "Improving the Performance of Photo-Electrically Controlled Lighting Systems," *Journal of the Illuminating Engineering Society*, Winter 1989.

Masshardt, "Helligkeitsregulierung von Hochdruck--Gasentladungslampen," *Technische Rundschau*, No. 19, 1988.

*Primary Examiner*—David C. Nelms

*Attorney, Agent, or Firm*—Scully, Scott, Murphy & Presser

[57] ABSTRACT

A method and circuit arrangement for adapting the light intensity of the summation light ($E_i$) of a room lit by internal light ($E_k$) and external light ($E'_i$) to the external light ($E_a$), which varies with the time of day, in which the light intensity of the internal light is controlled in dependence on one or more control parameters according to a given function and the function can be varied according to individual preference, are to be arranged so as to provide means of making finer adjustments to the light intensity in a room. This is achieved by determining the function by a plurality of independently settable function values (11), each function value (11) being variable independently of other function values (11).

15 Claims, 5 Drawing Sheets

Figure 1:
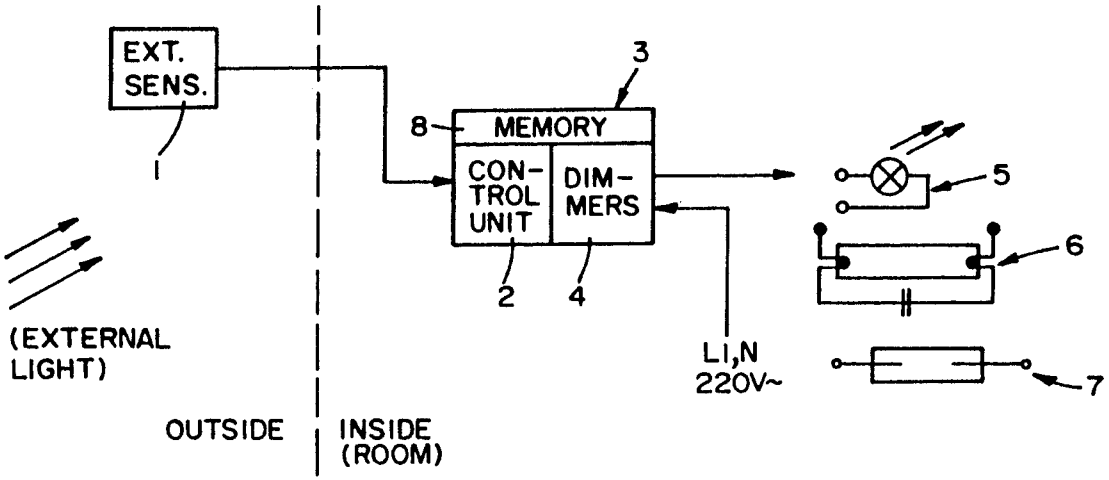

METHOD FOR ADAPTING THE LIGHT INTENSITY OF THE SUMMATION LIGHT TO THE EXTERNAL LIGHT

The invention relates to a method for adapting the light intensity of the summation light of a room lit by internal light and external light to the external light, which varies with the time of day, in which the light intensity of the internal light is controlled in dependence on one or more control parameters according to a given function and the function can be varied according to individual preference.

Methods of this kind are used to compensate for variations in light intensity in a room caused by changes in the external light. To detect the light intensity of the external light an external light sensor is arranged outside the room to be lit. The light intensity of the internal light is controlled in substantially inverse dependence on the external light: when the external light decreases the light inside the room is made brighter.

In the "Journal of the Illuminating Engineering Society, (Winter 1989, pages 70–90) a method and a lighting system for carrying it out are described for a room, in which a light-sensitive sensor is connected to a control unit, which in turn controls a dimming unit. The dimming unit controls light sources arranged in the room which generate a dimmed light level. The light-sensitive sensor is arranged so that it cannot detect the dimmed light level of the light sources. The control of the light sources takes place in accordance with an inverse linear dependence of the dimmed light level on the detected sensor signal. The slope of this function defining the dependence is set by a scale factor. The calibration is performed on commissioning the lighting system at a desired time of day.

A method of this kind has the disadvantage that setting the slope of the linear function changes not only the dimmed light level at the time of the calibration but also the dimmed light levels associated with all other light intensities of the external light.

It is an object of the invention to provide a method and a circuit arrangement which give finer setting possibilities for adapting the light intensity in a room.

This object is achieved in a method of the kind described in the introduction in that the dependency function is determined by a plurality of function values that can be set independently of one another and in that each function value can be varied independently of other function values.

The invention makes use of the idea that an individual lighting requirement is not met by selecting a single parameter of the function, for example the slope or the parallel displacement, but rather it can only be met by determining the function through individual points or sections.

The invention takes advantage of the discovery that even a complicated dependency of the light intensity of the internal light on the light intensity of the external light, the summation light or the time can be defined by relatively few function values that can be determined independently of one another. This enables all individual lighting requirements to be taken account of in a user-friendly manner.

The present invention also takes into account the adaptation of the structural illumination of a room, which may depend not only upon the intensity of the external light but also on the direction of daylight. According to the invention the distribution of the light intensity in the room can be adapted in dependence on the daylight so that a particular and possibly non-uniform distribution of light in the room can be realised. This is accomplished by connecting one or more, preferably two, independent light sensors to an independent dimmer unit or units that control a plurality of internal light sources arranged at different positions (x,y) in the room such that the illumination of the room can be changed independently of the external light falling on the external light sensors.

Figure 7:
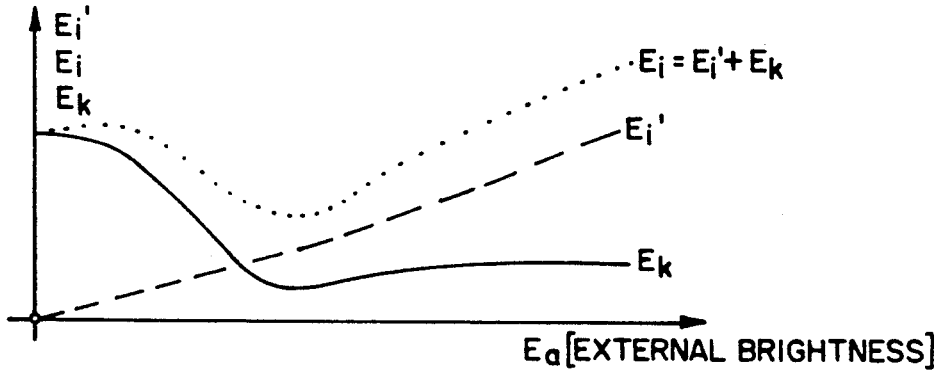

An observer in a room perceives, as shown for example in FIG. 7, the sum of the light intensity of the incoming external light $E_i'$ and of the artificially produced internal light $E_k$ as the total light intensity of the summation light $E_i$. The person in the room can now, on the one hand at any time of day and on the other hand under any given lighting conditions select a corresponding light intensity for the internal light and thus select the light intensity of the summation light, i.e. the internal brightness, without having to concern himself or herself with the actual dependency function. This function is determined according to the invention by the selection of individual points.

It is true that reference FR 2,174,679, which was published in 1973, shows an apparatus and a suitable method by which the percentage of brightness reduction of illumination inside a room is reduced in response to a function, cutting the function of the external brightness. In doing so, however, the brightness signals from photocells arranged at the side of the external wall are connected by a network of diodes for selection of the highest level of brightness. Independent brightness control by independent dimmers is thus not possible.

The invention will now be explained in more detail with reference to exemplary embodiments.

Figure 2:
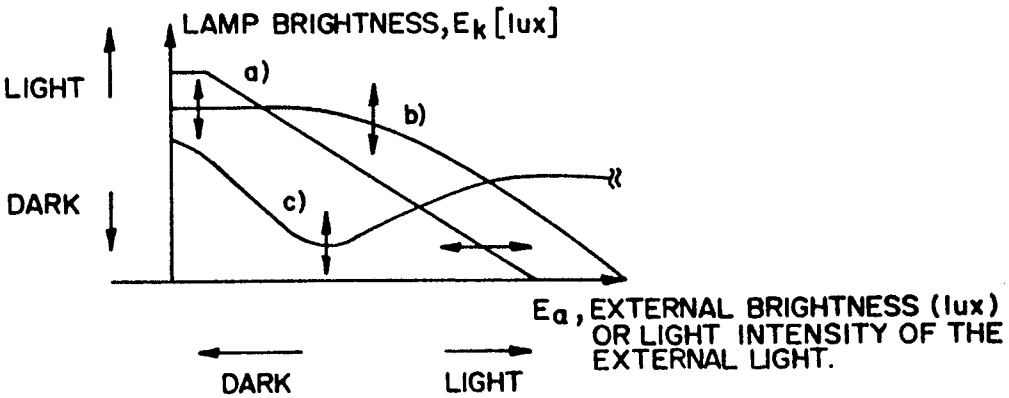
Figure 3:
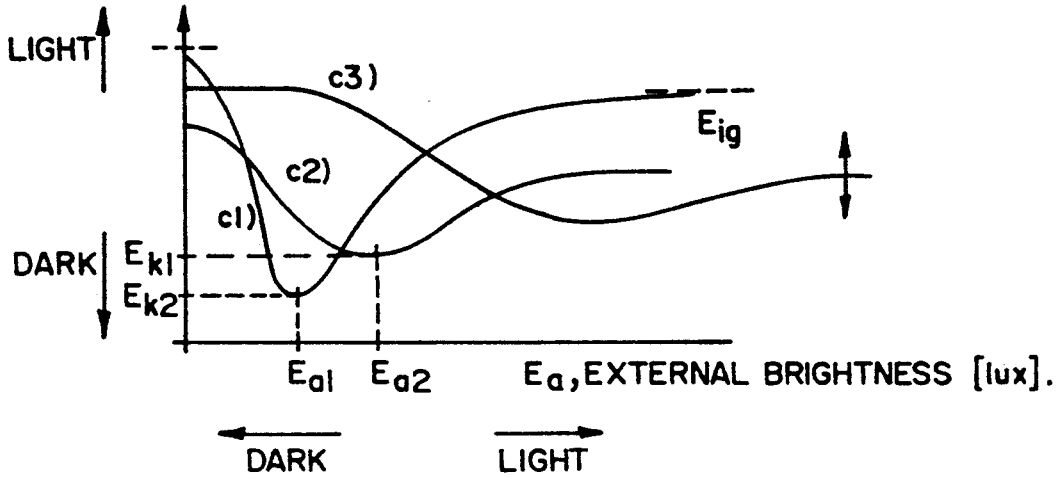
Figure 4:
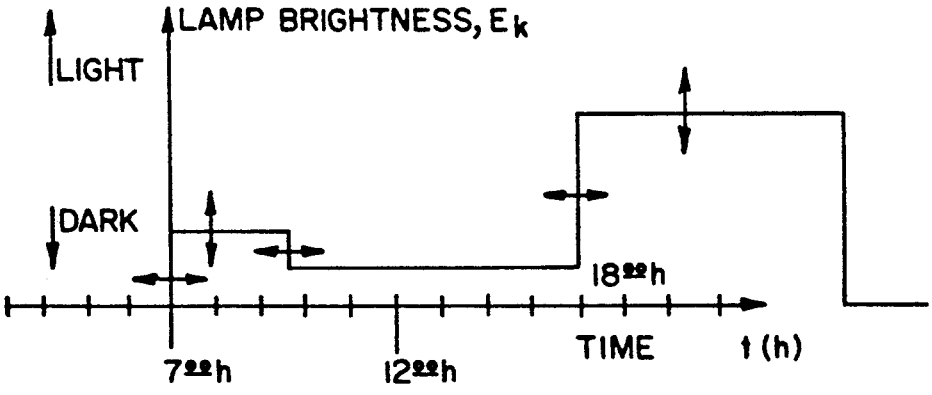
Figure 5:
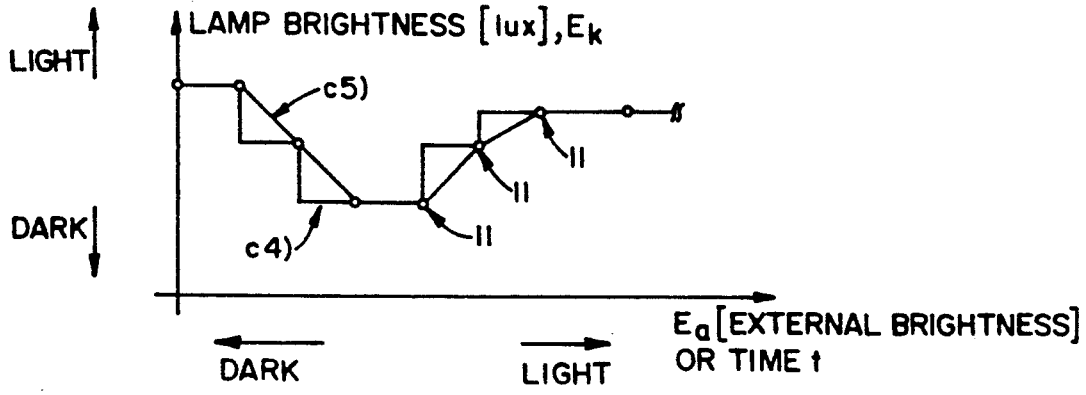
Figure 6:
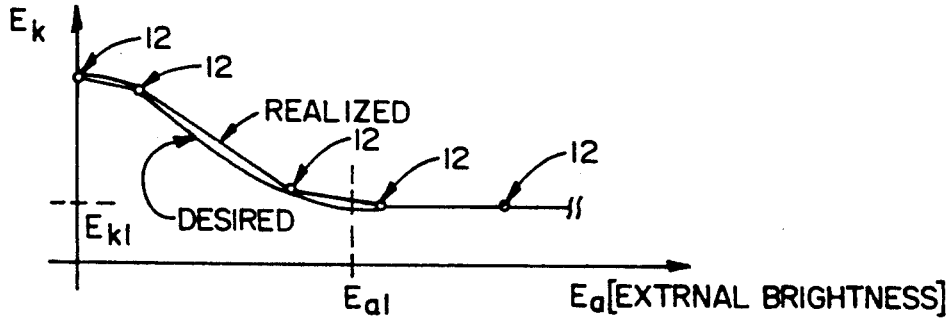

FIG. 1 shows as a block diagram a circuit arrangement for adapting the light intensity of the internal light, FIG. 2 shows possible dependency functions of the light intensity of the internal light on the light intensity of the external light, FIG. 3 shows special dependencies that can be used to avoid extreme differences in the light intensity, FIG. 4 shows an individual dependency relationship of the light intensity of the internal light on the time of day, FIG. 5 shows a dependency relationship between the light intensity of the internal light and the light intensity of the external light that is determined by a sequence of values and completely defined by interpolation, FIG. 6 shows a further dependency relationship of the light intensity of the internal light on the light intensity of the external light at the time of day or on the summation light intensity, FIG. 7 shows a relationship between the light intensity of the summation light, the light intensity of the internal light and the light intensity of the external light.

Figure 8:
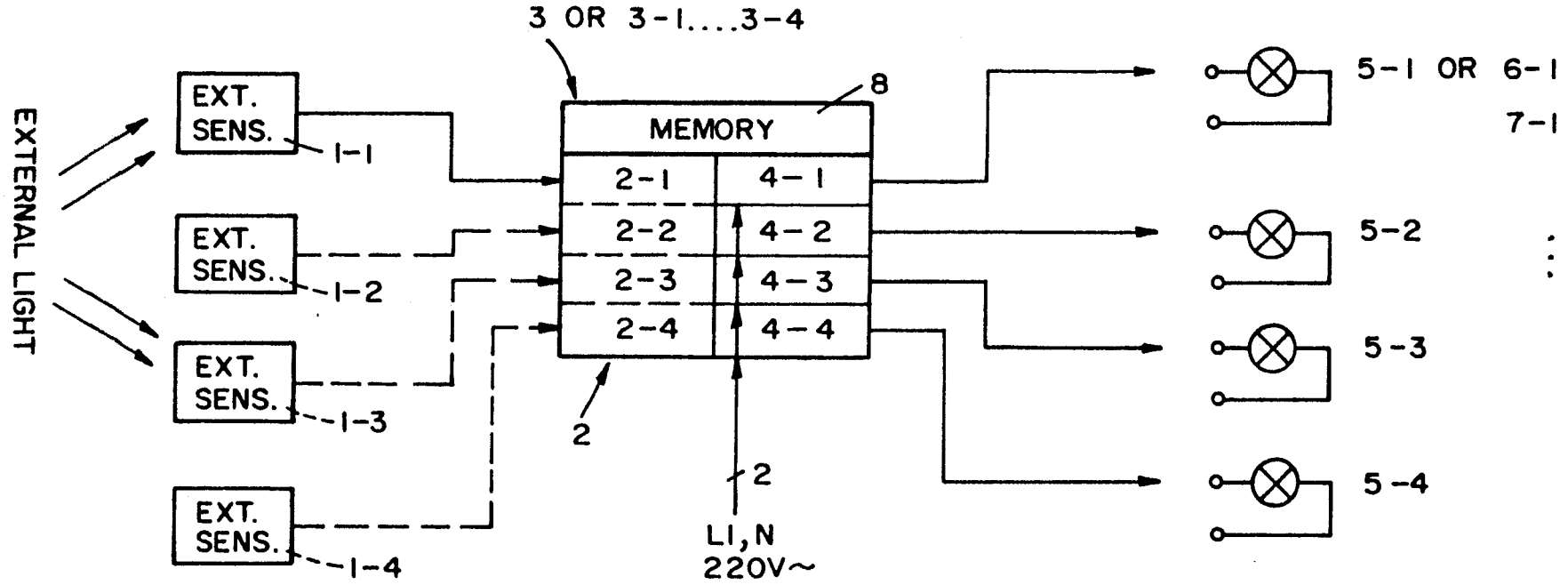
Figure 10:
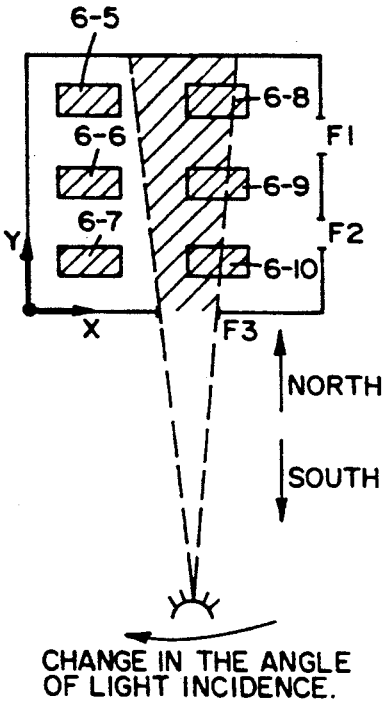
Figure 9:
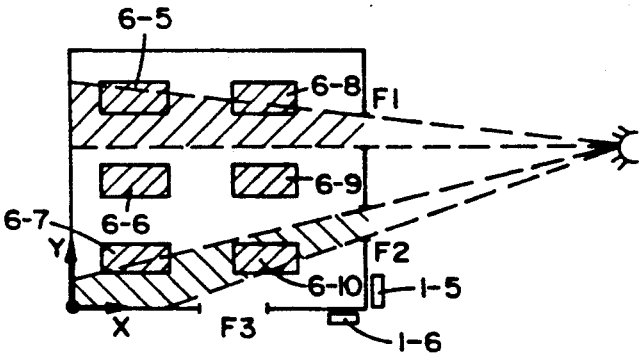
Figure 11:
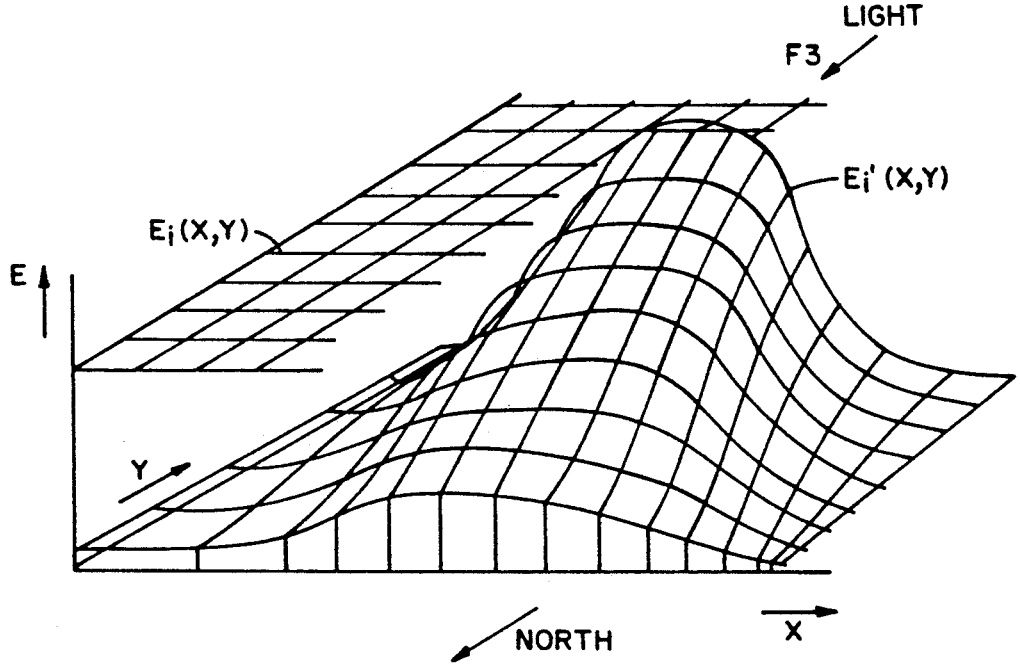

FIG. 8 shows a further exemplary embodiment of the invention with several external light sensors and dimmers or dimming units, FIG. 9 is a schematic sketch showing a room with three windows illuminated by internal light ($E_k$) and incoming external light ($E_i'$), FIG. 10 shows a room identical to the one in FIG. 9 with light incident at a different angle, FIG. 11 shows three-dimensional distribution of the light intensity ($E_i'$) in the room shown in FIG. 10.

FIG. 1 shows an exemplary embodiment of the invention with an external light sensor 1, a dimming unit 3 and light sources 5, 6, 7 that can be connected thereto. The dimming unit 3 comprises a control unit 2, a non-volatile read/write memory 8 and several dimmers 4, of which only one is shown to explain the manner of operation. Several lighting units may be provided in a room, each being controlled according to a different function of the external light (common external light sensor). The different functions are stored in the (preferably common) read/write memory 8. The external light sensor 1 supplies a light-intensity-dependent control signal to the control unit 2, which in turn, according to determined values 11 in the memory 8, supplies a predetermined phase control signal to the dimmer 4 by means of which the light intensity of the light sources 5, 6, 7 is set. For example incandescent lamps 5, gas discharge lamps 6 or arc lamps 7 may be used as light sources. In the case of the gas discharge lamps 6, instead of using phase control dimmers (through $\alpha$), EVG's (electronic ballasts) may for example be used whose dimming function can be adjusted through the variation of their output frequency and/or their output pulse control factor.

The curve a) in FIG. 2 shows a linearly decreasing light intensity of the internal light with increasing light intensity of the external light. An observer present in the room, i.e. in the interior, now perceives, as already explained with reference to FIG. 7, the sum of the internal light intensity $E_k$ and, depending on the arrangement and size of the areas in the room that are permeable to light, a more or less large fraction $E_i'$ of the light intensity of the external light $E_a$. Depending on individual preference a person present in the room can set a summation light intensity $E_i$, for example one that is constant, by adapting the slope of the function a) or its displacement in the $E_k$ or $E_a$ direction. If a light intensity characteristic of the internal light according to curve c) is selected there is, with increasing external brightness $E_a$, also a region in which the light intensity $E_k$ of the internal light gradually becomes (directly) proportional to the light intensity of the external light $E_a$. It is thus possible, despite increasing light intensity of the external light, to increase the light intensity of the internal light $E_k$ and to reduce the contrast, i.e. the difference in light intensity between the interior and the exterior. This is desirable to avoid silhouettes if one looks at an object or a person from well inside the room against a window side. The double arrows drawn on the functions a), b), c), c1), c2), c3) indicate possibilities of displacement and variation to adapt to desired function characteristics. If individual points of the function curve c) or of the function curves c1), c2) or c3) are determined individually and independently of one another and stored in the memory 8, precise reproducibility of a once defined function is possible.

The function curves shown in FIGS. 2, 3, and 6 are drawn as uniform and continuous; point-by-point storage and complete definition would require an infinite number of points. If now, as shown in FIG. 5, a desired dependency relationship is determined by a finite number of values 11, an interpolation, which must be determined in advance, determines how the continuous function characteristic controlling the light intensity is generated.

For example in FIG. 5 eight points are defined, which with a linear interpolation lead to function c5) and with stepped interpolation lead to function c4). Quadratic interpolations to compensate for discontinuities in the function curve are also possible. The values 11 in the memory 8 are read by the control unit 2 depending on the control signal of the daylight sensor 1 and a corresponding supply voltage phase angle control signal is supplied to the dimmer 4, which for example sets the light intensity of the internal light according to the c5) function. If the external light has a light intensity that lies between predetermined values 11 the control unit 2 reads the two neighbouring values from the memory 8 and determines, according to the set interpolation, the desired light intensity value $E_k$.

FIG. 4 shows the form of a light intensity function in dependence on the time of day. The light intensity of the internal light $E_k$ and the times at which the desired and preset light intensities of the internal light are switched on can also be seen here in the step-like function. An observer in a room now has the optical impression of the external light coming in through glass areas and of the time-dependently controlled lamp light. The individually desired room brightness or light intensity are thus obtained for a particular day and for predetermined weather conditions.

FIG. 6 shows a particular case of a light intensity characteristic $E_k$ of the internal light with a constant minimum. A light intensity curve of this kind could, as shown, be approximated satisfactorily with as few as five values 12 by linear interpolation.

Further improved possibilities for adjustment can be achieved by combining the method shown in FIG. 4 (time-control) and the light intensity control shown in FIG. 5, function c5).

Here the lamp light intensity is basically controlled in dependence on the time (coarse setting), i.e. certain times of the day are associated with basic light intensities and the fine adaptation in the direction of the double arrow in FIG. 4 is controlled by the light intensity of the external light. The two dependencies can be interchanged so that the basic light intensity is predetermined in dependence on the external light while the fine setting of the light intensity $E_k$ is time-dependent. This gives an operator a simpler way of influencing the result.

FIG. 8 shows a further exemplary embodiment of the invention comprising an external light sensor 1—1, a dimming unit 3 and a plurality of light sources 5—1, 5—2, 5—3 and 5—4 that can be connected thereto. The dimming unit 3 has a control unit 2, a non-volatile read/write memory 8 and a plurality of dimmers 4—1, 4—2, 4—3 and 4—4. A control signal generated by the external light sensor 1—1 is supplied to the control unit 2 and each light source that can be connected, for example 5—4, is controlled by a respective dimmer, for example 4—4. The control unit 2 is here a single unit, but it could alternatively be in four parts to control the four dimmers 4—1, 4—2, 4—3, 4—4; these four control unit parts are then controlled through parallel inputs by a single external light sensor 1—1. Furthermore a plurality of dimming unit parts 3—1, 3—2, 3—3 and 3—4 can be used for controlling respective internal light sources as shown in FIG. 1, the control signal generated by the external light sensor 1 being supplied as parallel inputs to the inputs to the plurality of dimming unit parts. It must be understood that the restriction to four dimmers or four dimming unit parts is here only by way of example; any desired number of dimming unit parts or dimmers with a corresponding number of internal light sources may be used.

The non-volatile read/write memory 8 holds a plurality of values 11, 12 which define a plurality of functions c1, c2, c3, c4, c5 that can be varied independently of one another. Depending on the control signal generated by the external light sensor 1—1 and supplied to the control unit or units 2, 2—1, 2—2, 2—3 and 2—4, the four dimmers 4—1, 4—2, 4—3, 4—4 are supplied with different predetermined phase control signals in dependence on four different functions defined by the plurality of values 11, 12. The different functions for the control of the respective dimmers or internal light sources are stored together in the non-volatile read/write memory 8.

The plurality of functions (in this case four are assumed) allow independent control of the internal light sources 5—1, 5—2, 5—3 and 5—4 that can be provided at different positions in a room. All the control unit parts 2—1, 2—2, 2—3, 2—4 controlling the dimmers 4—1, 4—2, 4—3 and 4—4 receive the same light-intensity-dependent signal from the external light sensor 1—1. It is thus possible to set up the light intensity distribution in a room individually, i.e. not only together as a simple function of the brightness but, for example, staggered in dependence on the depth of the room. In this way particularly large differences in brightness within a room can be compensated for by using different control functions and respective associated internal light sources at positions in the room that can be determined individually.

A variant of the exemplary embodiment shown in FIG. 8 consists in using, instead of one external light sensor 1—1, several external light sensors, in the present case four external light sensors 1—1, 1—2, 1—3 and 1—4, to control the four control units 2—1, 2—2, 2—3 and 2—4. Here each external light sensor, for example 1—2, controls a respective control unit, for example 2—2. A multi-dimensional arrangement such as this can likewise be realised by means of several different dimming units 3—1, 3—2, 3—3 and 3—4. A respective dimming unit, for example 3—1, is then activated by a particular external light sensor, for example 1—1. In an arrangement such as this it is not only possible to vary the internal light in dependence upon the brightness outside but also to influence it in dependence upon the direction of the external light, i.e. in dependence on the point of the compass or the steepness with which the external light strikes the external light sensor.

Influencing the light intensity of the internal light by means of the circuit arrangement shown in FIG. 8 may be done in the same manner, as illustrated by way of example in FIG. 5. For a better understanding of the description of the present invention the non-linearities occurring in the dimmer 4, i.e. the dependency of the light intensity of the internal light level on the turn-on angle $\alpha$ (supply voltage phase control angle) of the dimmer or of the output frequency of an electronic ballast device, are not mentioned in detail. However, these factors are taken into consideration by the control unit 2 in the calculation, storage and alteration of the light intensity values in the memory 8.

To show clearly the principle of the room illumination that is possible with a circuit arrangement shown in FIG. 8, FIGS. 9 and 10 each show the same room which has windows F1, F2 and F3 through which external light $E_a$ can enter said room $E_i'$. At the same time the points of the compass are indicated. The windows F1 and F2 are on the east side, the window F3 is on the south side. In the room there are six internal light sources (artificial light sources) 6—5, 6—6, 6—7, 6—8, 6—9 and 6—10, arranged symmetrically on the ceiling of the room. By way of example, in FIG. 9 a pair of sensors 1—5 and 1—6 are arranged in the south-east corner by means of which both the external light intensity $E_a$ and its direction can be detected. Drawn in the south-west corner is an x/y coordinate system which indicates more clearly the positional dependency in the room and which corresponds to the x/y coordinate system in FIG. 11. Six independently controllable dimming units 4—5, 4—6, . . . 4—10 must therefore be provided in the circuit arrangement shown in FIG. 8. If, as shown in FIG. 9, two independent external light sensors 1—5, 1—6 are provided, the former being oriented facing east and the latter facing south, a common control unit 2 can be provided for the six dimming units 4 which supplies brightness values $E_k$ from the memory 8 that depend on the direction of the external light and the external light brightness $E_a$ to each of the six dimming units individually.

By way of example, the lamps 6 shown in FIGS. 9 and 10 are gas discharge lamps such as are preferably used for ceiling-mounted individual or row lighting with frequency-controlled electronic ballast devices (EVG).

If at first no artificial light $E_k$ is generated the incident external light from the east enters through the two windows F1 and F2 and is restricted by the window opening. This incident external light $E_i'$ illuminates different segments of the room depending on the time of year and the time of day. In a room, for example an office or a conference room, in which uniform lighting is desired, it was up until now only possible to close off the windows and provide complete artificial lighting $E_k$. Hitherto this was only possible way to achieve uniform illumination.

By using the circuit shown in FIG. 8 with the six individually controllable internal light sources 6—5, . . . 6—10 that are shown by way of example, additional internal light (artificial light) $E_k(x,y)$ can now be generated in the room in dependence upon the intensity and the direction of the external light and be precisely selected in respect of amplitude $E_k$ and positional dependency x,y so that it forms the respective complement of the incident light $E_i'$.

With the incidence of light indicated in FIG. 9 one would, for example, switch on or increase the brightness of the lamp 6—6 and the lamp 6—9; the other four lamps could be switched off or turned down (dimmed) to a lower brightness value. This makes possible uniform illumination $E_i(x,y)$ of the room that is independent of the time of day and the time of year and at the same time saves energy.

If, as shown in FIG. 10, the incidence of light has moved so that now incident light from the south illuminates the room from outside through the window F3, other internal light sources must be switched on or have their brightness increased to adjust the brightness in the room. In the example shown these are the light sources 6—5, 6—6 and 6—7; the other three light sources, as already mentioned, could be switched off or dimmed. The larger the number of artificial light sources 5, 6 that can be dimmed independently of one another, the more uniformly can the overall room brightness $E_i(x,y)$ be levelled off.

FIG. 11 shows the positional dependency of the room brightness $E_i'(x,y)$ for the example shown in FIG. 10. The compass point indicated therein forms the orientation so that the maximum internal light intensity $E_i'$ is at the window F3 and so that towards the interior of the room this light intensity decreases both laterally and as the depth into the room increases. FIG. 11 shows the positionally dependent internal light intensity as a curved characteristic surf ace. If the aforementioned constant room brightness $E_i(x,y)$ is desired, which is substantially independent of position and which thus ensures the same uniform light level at each position in the room, the positionally-dependent difference between $E_i(x,y)$ and $E_i'(x, y)$ must be compensated by means of the internal light sources arranged in the room. This can be visualised with reference to the drawing shown in FIG. 11 in that the free space between the (predetermined) $E_i$-characteristic surface or plane (light intensity distribution) and the incident external light intensity distribution $E_i'$ can be supplemented by a positionally-dependent distribution of artificial light intensity $E_k(x,y)$. The more internal light sources that are provided and the more accurately the brightness of the external light and the direction of the external light can be determined and measured, the more accurately can the incident external light be supplemented by the positionally-dependent artificial light to make up the total internal light intensity (light level). The control unit shown in FIG. 8 is here of particular value because not only can light sources be switched on and off but also any desired intermediate levels of light intensity can be generated independently of position.

The artificial light intensity distribution $E_k(x,y)$ needed to complement the incoming external light can be determined point-by-point. A plurality of function values 11 which, as explained with reference to FIG. 5, can also define control characteristic lines (functions), in this case define control surfaces (characteristic surfaces) two-dimensionally and can be varied as desired.

Each dimming unit part 4—5, 4—6, . . . , 4—10, which controls one of the internal light sources shown, receives its (light intensity) command parameter individually from a control unit part 2. This may also be a phase control angle $\alpha$ if incandescent lamps with series-connected dimmers are used. The respective individual command parameter is, for example, calculated from the incident light striking the two external light sensors 1—5 and 1—6 shown. A plurality of sensors may be used. When using a plurality of external light sensors a limited angular region is associated with each external light sensor, within which it determines the light intensity (depending on the direction of the external light). The respective angular regions covered by each sensor directly adjoin or slightly overlap one another so that detection can be achieved over 270° (excluding the north).

Furthermore the elevation angle, which corresponds to the steepness of the light incidence depending on the time of year, can also be included with the detected azimuth angle regions covered. In the case of completely glazed walls the depth of the incident light changes; this can be compensated for by the control system shown in FIG. 8.

A further possibility of controlling the individual internal light sources 6—5, . . . , can be achieved if an individual control characteristic (artificial light intensity distribution) $E_k(x,y)$ is associated with each of these internal light sources. These characteristics are individually defined for each internal light source in the common memory 8 by respective corner points (amplitude values) 11. Depending on preferably two (east, south) external light sensors or their light intensity signals a light intensity value is individually determined for each internal light source with reference to its characteristic surface and supplied to the respective dimmer unit 4 as phase angle, frequency value or intended light intensity value. The respective individual characteristic surfaces thus form two-dimensional (curved) light intensity distributions, which can be adapted as desired to the conditions in the room and the size and number of windows by changing their corner values 11. Even a few corner points 11 (amplitude values) suffice to define a two-dimensional characteristic surface if the interpolation between the discrete corner points explained above is used as well.

Hitherto a substantially constant (total) internal light intensity distribution $E_i(x,y)$ was mentioned as being advantageous for offices or open office areas. Besides such a constant light level it may also be advantageous, for certain rooms, to select or prescribe the light intensity in dependence on position (room-coordinate-dependent). This is advantageous if particular areas of a room are basically to receive little or no light, while other areas, for example working areas, are to receive a larger proportion of the light. This gives rise to a light intensity profile for the individual room which is dependent on the room coordinates. Here, too, compensation for the influence of external light, in respect both of direction and of their light intensity, is obtained by the circuit arrangement shown in FIG. 8.

The two external light sensors 1—5 and 1—6 shown in FIG. 9 are only located in the southeast corner of the building or room by way of example: other possible positions, and common mounting on the roof of a building, can also be used for the purpose of the invention.

I claim:

1. A method for adapting the light intensity of the summation light of a room, lighted by internal light internal to the room, and by external light external to the room, to the light external to the room varying with the time of day, in which the light intensity of the internal light is controlled in dependence on one or more control parameters according to a function between the internal light and said one or more control parameters, with the function being variable according to individual preference, comprising the steps of:

a. generating said one or more control parameters by one or more external light sensors;

b. setting a plurality of independent values of the function in a memory, with each independent function value being variable and set in memory independently of the other independent function values; and c. defining said function from said plurality of independent values of the function set in memory according to a predetermined routine.

2. Method according to claim 1, wherein said step of defining the function includes the step of interpolating between two function values set in memory.

3. Method according to claim 2, wherein said step of interpolating is performed stepwise or linearly.

4. Method according to claim 1, wherein each of said plurality of independent function values set in memory is individually and independently retrievable and changeable.

5. Method according to claim 1, wherein said one or more control parameters include one or more of the external light, a summation of the internal light and the external light, and the time of day.

6. A circuit arrangement for adapting the light intensity of the summation light of a room, lighted by internal light internal to the room and by external light external to the room, to the external light varying with the time of day, in which the light intensity of the internal light is controlled in dependence on one or more control parameters according to a function between the internal light and said one or more control parameters, with the function being variable according to individual preference, comprising:

a. one or more independent external light sensors;

b. one or more independent dimmer units connected to said one or more independent external light sensors;

c. a plurality of internal light sources arranged at different positions in the room, controlled by said one or more independent dimmer units according to the function; and d. a memory having set therein the function defined by a plurality of independent function values set in the memory according to the predetermined routine, with each independent function value being variable and being set independently of other function values.

7. Circuit arrangement according to claim 6, wherein a single external light sensor controls a plurality of dimmer units by one or more control units in dependence on a plurality of different control functions, with one control function controlling each dimmer unit and each internal light source, such that each one of the plurality of internal light sources is controlled by one of the plurality of different control functions.

8. Circuit arrangement according to claim 6, wherein a plurality of external light sensors control a plurality of dimmer units by a plurality of control units in dependence on a plurality of different control functions, wherein each of the plurality of independent internal light sources is controlled by a respective one of the plurality of different control functions.

9. Circuit arrangement according to claim 6, wherein each of the plurality of external light sensors is positioned to sense external light received from different compass directions relative to the room, such that the level of external light sensed by the plurality of external light sensors is dependent on the brightness of the external light and the direction of the external light, whereby the illumination of the room is changed in a position-dependent manner.

10. Circuit arrangement according to claim 6, wherein said memory comprises a read-write memory in which the plurality of control functions are stored, and the plurality of control functions are determined independently of one another by a plurality of independently settable function values.

11. Circuit arrangement according to claim 6, wherein the room is illuminated over its surface, and:

a. a light intensity distribution is set over the surface of the room, of which the position-dependent (x,y) amplitude determines the light intensity at each position (x,y) in the room;

b. the internal light sources arranged in the room produce over the surface of the room, in concentrated positions, an additional light distribution, of which the position-dependent amplitude determines at each position in the room an additional light intensity; and c. the internal light sources are controlled such that the addition of the light intensities of position-dependent incidence of external light and internal light distribution produces a light intensity distribution substantially independently of internal light intensity and time.

12. Circuit arrangement according to claim 11, wherein the light intensity distribution is substantially independent of position, with its predetermined amplitude determining the total internal light level, comprising incident external light and internal light.

13. Circuit arrangement according to claim 11, wherein the control parameter of each dimmer unit connected with each internal light source is determined by a common control unit from the angle of incidence and the brightness of the external light.

14. Circuit arrangement according to claim 11, wherein two external light sensors are positioned externally of the room to detect the brightness of the external light received from different compass directions relative to the room, and independently of the light intensity signals from the two external sensors, an internal light intensity or phase control angle is read from the memory for a respective internal light source, with an independent characteristic surface being stored in the memory for each internal light source.

15. Circuit arrangement according to claim 11, wherein the control functions, by which the light intensity of each internal light source is predetermined independently, are set and varied by a plurality of variable discrete amplitude values.

* * * * *